United States Patent [19]

Michel et al.

[11] 4,075,766

[45] Feb. 28, 1978

[54] APPARATUS FOR THE TREATMENT OF DIVIDED SOLID MATERIAL

[75] Inventors: Basil J. Michel, Rochester; Gary P. Morse, Spencerport, both of N.Y.; Alfred L. Wilcox, Arlington Heights, Ill.

[73] Assignee: General Signal Corporation, Rochester, N.Y.

[21] Appl. No.: 706,986

[22] Filed: Jul. 19, 1976

[51] Int. Cl.[2] ..... F26B 17/14

[52] U.S. Cl. ..... 34/57 D; 34/166; 34/173; 34/229; 34/241

[58] Field of Search ..... 34/57 A, 57 D, 166, 34/173, 168, 182, 229, 241, 181; 110/8

[56] References Cited

U.S. PATENT DOCUMENTS

| | | | |
|---|---|---|---|
| 333,939 | 1/1886 | Foote | 34/166 |
| 1,529,808 | 3/1925 | Pike et al. | 34/241 |
| 3,423,843 | 1/1969 | Laguilharre | 34/57 D |
| 3,967,975 | 7/1976 | Idaszak | 34/10 |

*Primary Examiner*—John J. Camby
*Assistant Examiner*—Larry I. Schwartz
*Attorney, Agent, or Firm*—Jeffrey S. Mednick; Harold Huberfeld

[57] ABSTRACT

An apparatus for the treatment of divided solid material is provided having a chamber disposed about a generally vertical axis. Means are provided for introducing the divided solid material into the top portion of the chamber and further means are provided for introducing a pressurized gas into the bottom portion of the chamber. The apparatus includes first impeller means, supported by a first shaft adapted to rotate about the axis, and situated in the top portion of the chamber, for fluidizing the divided solid material in the top portion of the chamber to thereby prevent the divided solid material from clogging within the top portion of the chamber. Additionally, the apparatus includes second impeller means, spaced from the first impeller means, supported by a second shaft adapted to rotate about the axis, and situated in the bottom portion of the chamber, for radially dispersing the pressurized gas and for fluidizing the divided solid material in the bottom portion of the chamber. The means for introducing pressurized gas may be affixed to the second impeller means and adapted to rotate therewith to thereby aid in the radial distribution of the pressurized gas.

4 Claims, 3 Drawing Figures

APPARATUS FOR THE TREATMENT OF DIVIDED SOLID MATERIAL

BACKGROUND OF THE INVENTION

The present invention relates generally to an apparatus for the treatment of divided solid material and more particularly to a mixing apparatus for fluidizing and drying divided solid material in a vertical chamber.

In the processing of divided solid material, for example, the processing of foods such as flour, before packaging, it has been found to be desirable to create a fluidized bed of such material by feeding the material into a chamber and simultaneously feeding a pressurized gas such as air into the same chamber. For example, U.S. Pat. No. 3,075,298 to Schaub shows a cylindrical tower through which particulate material is fed in a downward direction from a screw feeder to a rotary valve output. Simultaneously, a treating gas under pressure enters the tower at the bottom thereof and passes upward through the falling particulate material at a rate insufficient to prevent the falling of the particulate material. This patented system also includes a plurality of guide members mounted on a centrally-located shaft within the tower. The shaft may be rotated during operation to thereby permit the guide members to force the falling particulate material into a helical flow pattern.

As an aid in controlling the exposure of the divided solid material to the gas, it has been proposed to place tubes lengthwise within the chamber so as to permit the divided solid material to pass downward through the tubes while simultaneously permitting the pressurized gas to pass upward through the tubes. This type of apparatus in the past has included a porous grid diffuser in the bottom portion thereof to disperse the incoming gas. However, this apparatus has tended to plug up, resulting in heat build-up within the chamber and frequent explosions.

SUMMARY OF THE INVENTION

Accordingly, the present invention provides an apparatus for the treatment of divided solid material having a chamber disposed about a generally vertical axis. Means are provided for introducing the divided solid material into the top portion of the chamber and further means are provided for introducing a pressurized gas into the bottom portion of the chamber. The apparatus includes first impeller means, supported by a first shaft adapted to rotate about the axis, and situated in the top portion of the chamber, for fluidizing the divided solid material in the top portion of the chamber to thereby prevent the divided solid material from clogging within the top portion of the chamber. Additionally, the apparatus includes second impeller means, spaced from the first impeller means, supported by a second shaft adapted to rotate about the axis, and situated in the bottom portion of the chamber, for radially dispersing the pressurized gas and for fluidizing the divided solid material in the bottom portion of the chamber. The means for introducing pressurized gas may be affixed to the second impeller means and adapted to rotate therewith to thereby aid in the radial distribution of the pressurized gas.

OBJECTS OF THE INVENTION

Thus, an object of the present invention is the provision of an apparatus for the treatment of divided solid material which will prevent clogging and bridging of the solid material within the apparatus.

Another object of the present invention is the provision of an apparatus for the treatment of divided solid material which will assure uniform radial distribution of gas and solid material within the apparatus.

A further object of the present invention is the provision of an apparatus for the treatment of divided solid material having improvements which can be readily adapted to existing apparatuses.

Still another object of the present invention is the provision of an apparatus for the treatment of divided solid material which is relatively inexpensive and easy to manufacture.

Other objects, advantages, and novel features of the present invention will become apparent from the following detailed description of the invention when considered in conjunction with the accompanying drawings.

DESCRIPTION OF THE PREFERRED EMBODIMENTS

Figure 1:
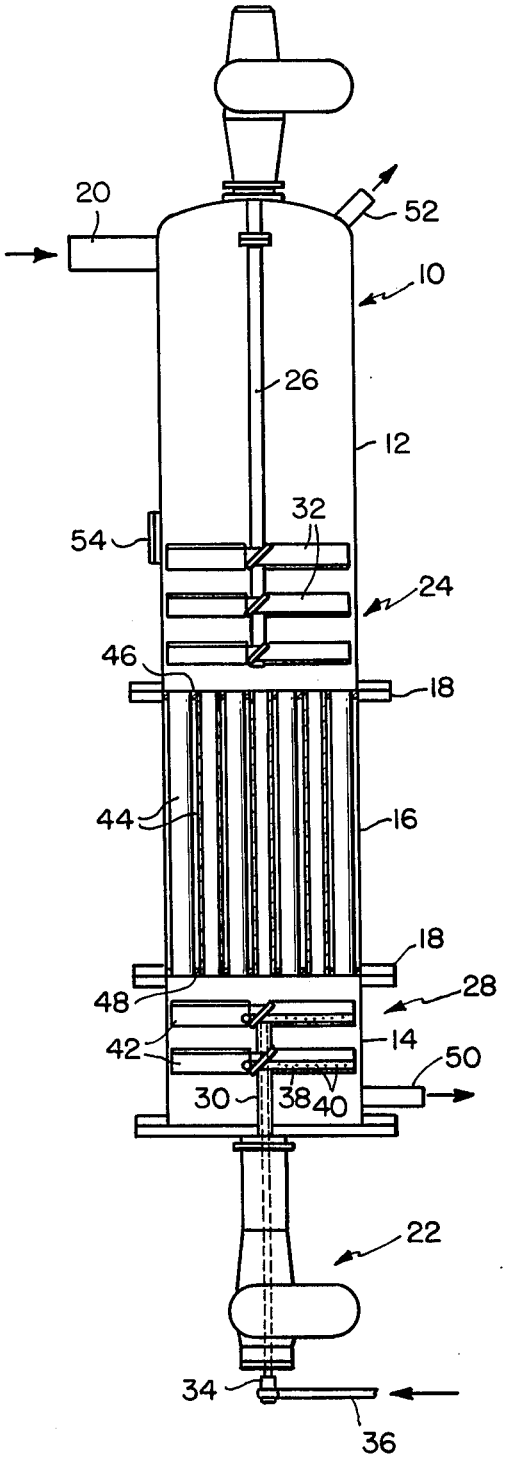
FIG. 1 shows a cross-sectional view of a first embodiment of the apparatus of the present invention.

Referring to the drawings, FIG. 1 shows a chamber 10 disposed about a generally vertical axis. The chamber 10 is preferably a cylindrical tower having a top portion 12, a bottom portion 14 and a central portion 16. The three portions 12, 14, and 16 are securely fastened to one another preferably by means of flanges 18, by any suitable fastening means. The chamber 10 may be made of any material of suitable strength but is preferably made of a material which will not rust, such as stainless steel.

Suitable means 20 are provided for introducing divided solid material, for example, flour, into the top portion 12 of the chamber 10. The means 20 may be a standard screw feeder. A means 22 is provided for introducing a pressurized gas, preferably air, into the bottom portion 14 of the chamber 10. The apparatus further includes impeller means adapted to rotate about the axis of the chamber 10 for radially dispersing the pressurized gas and for fluidizing the divided solid material within the chamber 10. The impeller means preferably includes a first impeller means 24 supported by a first shaft 26 adapted to rotate about the axis of the chamber 10. The first impeller means 24 is situated in the top portion 12 of the chamber 10, for fluidizing the divided solid material in the top portion of the chamber to thereby prevent the divided solid material from clogging therein. The impeller means further includes a second impeller means 28 situated in the bottom portion 14 of the chamber 10. In the embodiment shown in FIG. 1, the second impeller means 28 is spaced from the first impeller means 24 and is supported by a second shaft 30 adapted to rotate about the axis of the chamber 10. As is illustrated in FIG. 1, the first impeller means 24 preferably includes three sets of four blades 32, and the second impeller means 28 preferably includes two sets of four blades 42. Of course, the number of blades in each set and the number of sets of blades in the first and second impeller means may be altered, depending on the amount of agitation required and the size of the chamber 10. In the embodiment shown in FIG. 1, the second impeller shaft 30 is preferably hollow and is connected to a rotary joint 34 which is adapted to receive pressurized input gas from a stationary input conduit 36. A suitable joint is manufactured by the Barco Company.

The hollow shaft 30 is placed in fluid communication with a plurality of perforated tubes 38 affixed to each blade of the second impeller means 28. The tubes 38 may be made from stainless steel tubing, are open at their ends, and contain a plurality of holes 40 along the upper outer surface thereof. The tubes 38 may be welded to each of the blades 42 of the second impeller means 28. In certain embodiments the tubes 38 may be threadingly engaged with the wall of the hollow shaft 30 and thereby supported by the shaft 30. The perforated tubes 38 serve to aid in the radial distribution of the pressurized gas entering at 36. Thus the means 22 for introducing pressurized gas into the bottom portion 14 of the chamber 10 includes conduit 36, joint 34, hollow shaft 30, and perforated tubes 38.

The central portion 16 of the chamber 10 includes a plurality of tubular members 44 positioned within the chamber parallel to the chamber axis so as to separate the impeller means 24 from the impeller means 28, and to permit the flow of pressurized gas in an upward direction through the members 44 and simultaneously to permit the downward flow of the divided solid material through the members 44. The tubular members 44 are preferably arranged in a triangular pattern with respect to one another and are held in place by plates 46 and 48 at the tops and bottoms thereof respectively. The plates 46 and 48 prevent gas and solid material from passing between the tubular members 44. For purposes of illustration, in FIG 3, thirty-one of such tubes have been illustrated. However, in practice, a wide range of number and size of tubes 44 may be utilized to control the residence time and exposure of the divided solid material within the chamber 10. For example, up to several hundred tubes having an outside diameter ranging from one to eight inches may be utilized.

The chamber 10 may be further provided with an outlet conduit 50 for the dried, fluidized solid material, and with an outlet conduit 52 for the pressurized gas within the chamber 10. Further, any number of inspection covers 54 may be provided on the outer surface of the chamber 10.

In the operation of the apparatus of the present invention, divided solid material may be fed into the chamber 10 by feeder 20 at any suitable rate, depending on the size of the chamber 10 and the number and size of the tubes 44, while pressurized air is simultaneously fed into the conduit 36. The gas will be sufficiently pressurized to maintain a pressure drop of 2 to 4 pounds per square inch from the bottom of the chamber 10 to the top of the chamber 10. The impellers 24 and 28 will be driven by suitable motor means (not shown) at a rotational speed on the order of 50 to 350 revolutions per minute. Gas will be fed up through the hollow shaft 30 and out the holes 40 and the ends of tubes 38, to thereby be radially dispersed within the chamber 10. The divided solid material will tend to fall within the upper portion 12 of the chamber 10 and will be fluidized when mixed with the pressurized gas by the first impeller means 24. Thus the first impeller means 24 serves to prevent any bridging in the top portion 12 of the chamber 10 and to allow the divided solid material to drop through the tubes 44 and further to allow the pressurized gas to escape without any stagnation or build-up. The second impeller means 28, in addition to radially dispersing the pressurized gas, also serves to maintain the divided solid material in the lower portion 14 of the chamber 10 in a fluidized state.

Figure 2:
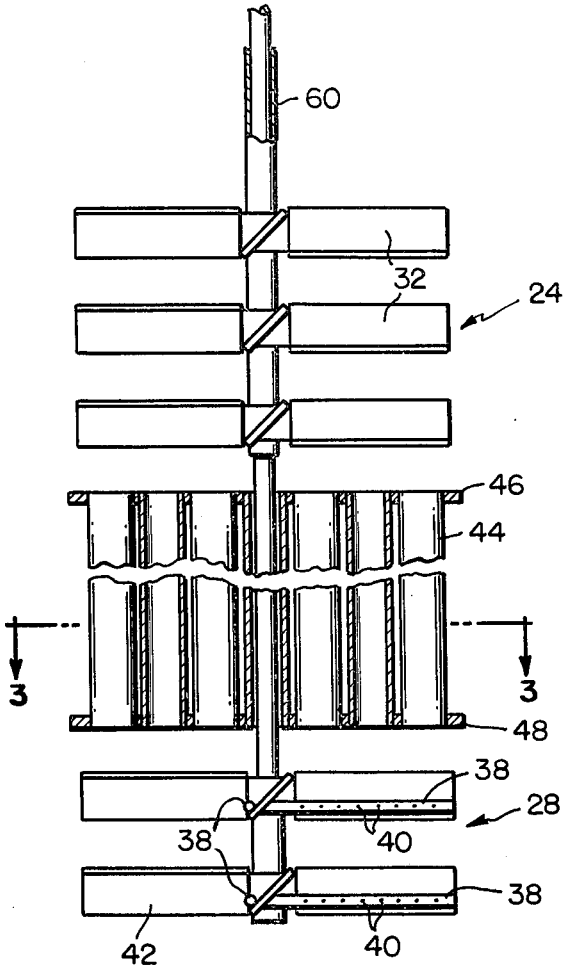
FIG. 2 shows a partial cross-sectional view of a second embodiment of the apparatus of the present invention.

In FIG. 2, a second embodiment of the apparatus of the present invention is shown, with like numerals being utilized to indicate components that are identical to those shown in the embodiment shown in FIG. 1. In the embodiment shown in FIG. 2, the first impeller means 24 and the second impeller means 28 are supported by a single hollow shaft 60 adapted to rotate about the axis of the chamber 10. The portion of the shaft 60 between impeller means 24 and 28 passes through the central tubular member 44. In this embodiment the means 22 for introducing pressurized gas into the chamber 10 is connected to the top of the chamber 10, with the conduit 36 and the joint 34 being connected to the top of the hollow shaft 60. Gas then passes through the entire length of the shaft 60 to the tubes 38 and the holes 40. In every other respect, the embodiment shown in FIG. 2 functions in an identical manner to the embodiment shown in FIG. 1.

Figure 3:
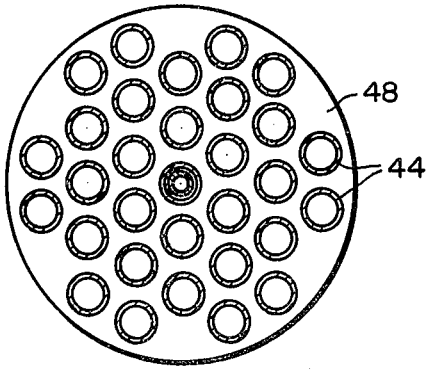
FIG. 3 shows a cross-section of the apparatus as shown in FIG. 2 taken along line 3—3.

FIG. 3 merely shows a cross-section of the embodiment shown in FIG. 2 taken at line 3—3. This illustrates the pattern of the tubular members 44 within the chamber 10. Thus it can be readily appreciated that by changing the number of tubular members 44 in the central section 16, or by changing the diameter of the tubular members 44, one can readily change the residence time of the divided solid material within the chamber 10.

Accordingly, the apparatus of the present invention provides a means for treating divided solid material while at the same time preventing clogging and bridging of the solid material within the apparatus. One way in which the apparatus accomplishes this is by assuring uniform radial distribution of the pressurized input gas and the solid material within the apparatus. Furthermore, it should be pointed out that the chamber 10 including sections 12, 14, and 16, feeder 20, and outputs 50 and 52 form no part of applicant's invention. This portion of the unit was designed by the Corn Products Corporation, a division of Corn Products International. However, it can be readily appreciated how applicant's improved gas distribution and impeller means can be readily adapted to this existing apparatus in a relatively inexpensive and easy-to-manufacture manner.

While there have been described what are at present considered to be the preferred embodiments of the present invention, it will be obvious to those skilled in the art that various changes and modifications may be made therein, without departing from the invention, and it is, therefore, aimed in the appended claims to cover all such changes and modifications as fall within the true spirit and scope of the invention.

What we claim is:

1. An apparatus for the treatment of divided solid material comprising:

(a) a chamber disposed about a generally vertical axis;

(b) means for introducing said divided solid material into the top portion of said chamber;

(c) means for introducing a pressurized gas into the bottom portion of said chamber; and (d) impeller means adapted to rotate about said axis for radially dispersing said pressurized gas and for fluidizing said divided solid material, said means for introducing pressurized gas being adapted to rotate with said impeller means to thereby aid in the radial distribution of said pressurized gas, wherein said impeller means is supported by a hollow shaft adapted to receive said pressurized gas and wherein said means for introducing pressurized gas comprises a plurality of perforated tubes affixed to said impeller means and adapted to rotate therewith, said perforated tubes being in fluid communication with said hollow shaft to thereby aid in the radial distribution of said pressurized gas.

2. An apparatus as set forth in claim 1 wherein said impeller means includes first and second impeller means and wherein the portion of said chamber between said top and bottom portions includes a plurality of tubular members positioned within said chamber parallel to said axis so as to separate said first and second impeller means to permit the flow of said pressurized gas in an upward direction through said tubular members and simultaneously to permit the downward flow of said divided solid material through said tubular members.

3. An apparatus as set forth in claim 2 wherein said first and second impeller means are supported by a shaft adapted to rotate about said axis, with the portion of said shaft between said first and second impeller means passing through one of said tubular members.

4. An apparatus as set forth in claim 1 wherein said impeller means includes a plurality of blades and wherein said perforated tubes are affixed to said blades.

* * * * *